US005586857A

United States Patent [19]

Ishii et al.

[11] Patent Number: 5,586,857

[45] Date of Patent: Dec. 24, 1996

[54] ROTATING STALL PREVENTION SYSTEM FOR COMPRESSOR

[75] Inventors: Hiroshi Ishii, Chiyoda-machi; Tetsuo Sasada, Hitachi; Masayuki Kasahara, Chiyoda-machi; Yasuhiro Katoh, Hitachi; Yasushige Kashiwabara, Katsuta, all of Japan

[73] Assignee: Hitachi, Ltd., Tokyo, Japan

[21] Appl. No.: 497,417

[22] Filed: Jun. 30, 1995

Related U.S. Application Data

[63] Continuation of Ser. No. 145,592, Nov. 4, 1993, abandoned.

[30] Foreign Application Priority Data

Nov. 11, 1992 [JP] Japan ..... 4-300803

[51] Int. Cl.[6] ..... F01D 17/00

[52] U.S. Cl. ..... 415/23; 415/13; 415/17

[58] Field of Search ..... 415/13, 17, 23, 415/48, 118

[56] References Cited

U.S. PATENT DOCUMENTS

| | | | |
|---|---|---|---|
| 2,950,857 | 8/1960 | Williams et al. | 415/17 |
| 3,156,437 | 11/1964 | Mercier | 415/23 |
| 3,327,933 | 6/1967 | Baumann et al. | 415/23 |
| 3,367,565 | 2/1968 | Urban | 415/23 |
| 3,677,000 | 7/1972 | Thomson | 415/23 |
| 4,205,941 | 6/1980 | Fradin . | |
| 5,165,844 | 11/1992 | Khalid | 415/48 |
| 5,346,359 | 9/1994 | Propst | 415/118 |

FOREIGN PATENT DOCUMENTS

| | | | |
|---|---|---|---|
| 2123831 | 2/1971 | France . | |
| 2391379 | 5/1977 | France . | |
| 0155206 | 9/1983 | Japan | 415/48 |
| 419425 | 8/1964 | Switzerland . | |
| 2119862 | 11/1983 | United Kingdom | 415/23 |
| 2191606 | 12/1987 | United Kingdom . | |
| 2248885 | 7/1991 | United Kingdom . | |

OTHER PUBLICATIONS

Active Control of Rotating Stall in a Low Speed Axial Compressor by J. Paduano, et al.–The American Society of Mechanical Engineers, 1991; pp. 1–10.

Patent Abstract of JP 58–202399 published Feb. 3, 1984, vol. 8, No. 47 (M–280) [1484] Mar. 2, 1984.

*Primary Examiner*—Edward K. Look
*Assistant Examiner*—Mark Sgantzos
*Attorney, Agent, or Firm*—Antonelli, Terry, Stout & Kraus

[57] ABSTRACT

A compressor has inlet guide vanes, rotor blades and stator blades. To prevent rotating stall, baffle vanes 5 capable of having their angles varied are installed upstream of the inlet guide vanes, actuators to vary the angles of baffle vanes are coupled to the baffle vanes, sensors installed upstream of the baffle vanes detect a rotating stall condition inside the flow passage of the compressor, and a control unit is responsive to signals from the sensors to output control signals to the actuators to vary the angles of the baffle vanes so as to prevent the rotating stall condition. Instead of the baffle vanes, fluid jets may be provided upstream of the inlet guide vanes for the same purposes.

9 Claims, 6 Drawing Sheets

ROTATING STALL PREVENTION SYSTEM FOR COMPRESSOR

This application is a Continuation of application Ser. No. 08/145,592, filed Nov. 4, 1993, now abandoned.

BACKGROUND OF THE INVENTION

The present invention relates to a rotating stall prevention system for a compressor, and more particularly to a rotating stall prevention system which is suitable for preventing a rotating stall from taking place during increasing or decreasing speed of the compressor.

In a high pressure ratio axial compressor having a plurality of stator blade rows and a plurality of rotor blade rows arranged between the stator blade rows, there are some cases where a partial stalling region, referred to as a cell, is caused by flow separation from the blades, and this partial stalling region or cell rotationally propagates at a speed of approximately half the rotating speed of the compressor, resulting in a so-called rotating stall. The rotating stall phenomena is caused by the circumferential inlet distortion of the fluid flowing into the blade rows. Therefore, the rotating stall phenomena has been understood to include circumferential distortion of the fluid before it flows into the blade rows.

A system for preventing such a rotating stall is described in the ASME paper 91-GT-88 issued in Jul. 26, 1991. The system described in this paper has a plurality of hot wire anemometers arranged in the peripheral direction of a casing to detect a rotating stall (circumferential inlet distortion of flow), and the setting angles of a plurality of inlet guide vanes are controlled with mutual phase differences based on the detected signals so as to eliminate the rotating stall in the peripheral direction. The setting angles of the inlet guide vanes are changed with DC motors operated by a command from a control circuit.

The disadvantages in conventional rotating stall prevention systems may be eliminated by the above mentioned prior technology since an unsteady state flow field is directly controlled in the prior technology. However, varying the setting angles of a plurality of the inlet guide vanes with mutual phase differences may deteriorate the essential function of the inlet guide vanes. As a result, the inlet flow directions under a steady state flow condition into the blades in the rear stages differ depending on the peripheral positions thereof, which leads to serious effects on the performances under a normal operation of the compressor, such as an efficiency drop.

SUMMARY OF THE INVENTION

An object of the present invention is to solve problems existing in the prior technology described above and to provide a rotating stall prevention system for a compressor which is efficient in preventing the rotating stall which, at the same time, producing little deterioration in the fluid performance of the compressor.

In order to attain the above object, according to the present invention, there is provided a rotating stall prevention system for a compressor, which has rotor blades and stator blades in the flow passage of the compressor inside its casing, wherein said rotating stall prevention system includes baffle vanes capable of having the attached angles thereof varied positioned upstream of said blade rows, actuators to vary the said baffle vanes being angles of said baffle vanes, flow sensors to detect the flow condition in said flow passage of the compressor, and control means responsive to detected signals from said sensors and to output control signals to said actuators for varying the angles of said baffle vanes in order to prevent the occurrence of a rotating stall condition by means of baffling flow in the upstream direction of said flow passage of the compressor, or wherein said rotating stall prevention system uses jet nozzles attached upstream of said blade rows, jet control valves to control compressed fluid flowing out of said jet nozzles, flow sensors to detect the flow condition in the flow passage of the compressor, and control means responsive to detected signals from said sensors and to output control signals for controlling said jet control valves in order to prevent the occurrence of a rotating stall condition by jetting fluid in upstream of said flow passage of the compressor.

Rotating stall is a phenomena where a partial stalling region, referred to as a cell, is caused by flow separation from the blades and the cell rotationally propagates at a speed of approximately half the rotating speed of the compressor. The flow velocity in the peripheral direction in a partially stalling region is larger than that in a non-stalling region, or the axial flow velocity in a partially stalling region is smaller than that in a non-stalling region, and the blade angle of attack against flow in a partially stalling region is larger than that in a non-stalling region. Further, the pressure in a partially stalling region is higher than that in a non-stalling region. That is, when a rotating stall takes place, the flow velocity and the pressure have uneven distributions in the peripheral direction. The most dominant factor causing initiation of the rotating stall is the inlet distortion (uneven distributions) in flow velocity, pressure and temperature at an inlet of the compressor due to the asymmetry in its shape and so on. The distortion gradually increases from the inlet of the compressor to the inlet of the blade rows to cause the rotating stall inside the blade rows. This rotating stall can be predicted or detected based on the signals from flow sensors. The detected signals are input into control means. The control means carries out a calculation to obtain the angles of the baffle vanes or the jet flow rates which make the flow in the passage of the compressor uniform in order to prevent the occurrence of rotating stall and controls the actuators or the control valves.

DETAILED DESCRIPTION OF THE PREFERRED EMBODIMENTS

Figure 1:
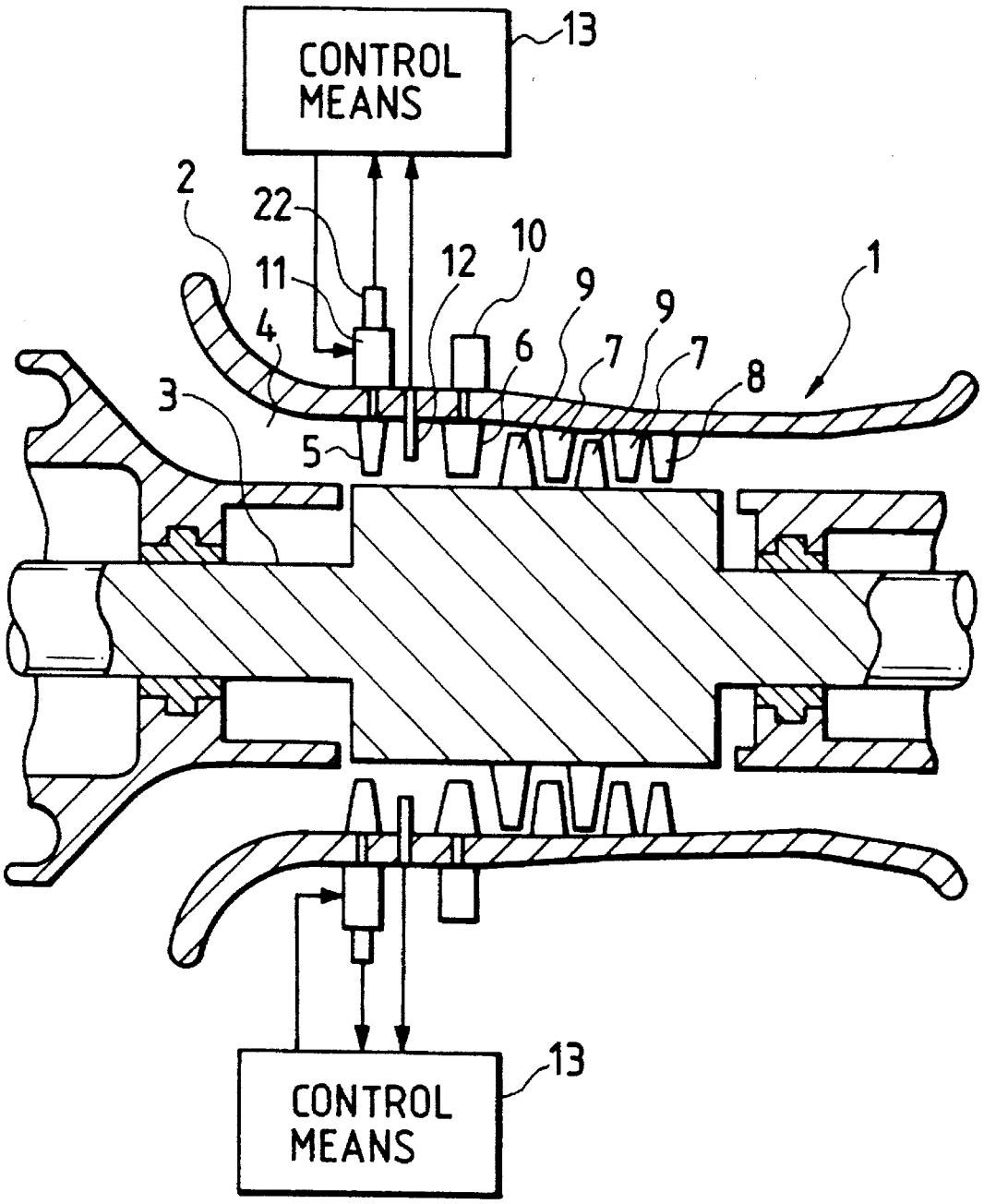
FIG. 1 is a longitudinal sectional view of a compressor incorporating an embodiment of a rotating stall prevention system in accordance with the present invention.

FIG. 1 shows a compressor having an embodiment of a system according to the present invention. In FIG. 1, a compressor 1 has a compressor flow passage 4 formed between a casing 2 and a rotor 3 installed therein. In the casing 2, there are provided, from the upstream side, baffle vanes 5, inlet guide vanes 6, stator blades 7 and exit guide vanes 8. The rotor 3 has rotor blades 9 at the positions between the inlet guide vanes 6 and the stator blades 7, and between stator blades 7.

The setting angles of the inlet guide vanes 6 described above are changed depending on the operating condition (rotating speed of rotor 3) of the compressor by an angle varying mechanism 10 so that the flow rate matches the rotating speed.

Figure 2:
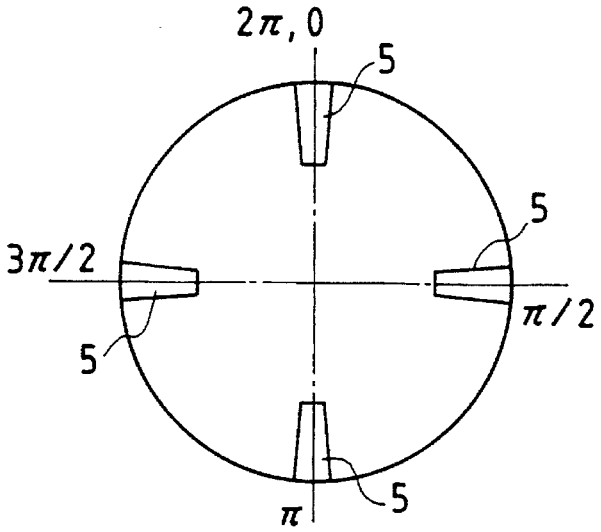
FIG. 2 is a front view showing an arrangement of baffle vanes in the compressor shown in FIG. 1.

The baffle vanes 5 installed upstream of the inlet guide vanes 6 are, as shown in FIG. 2, pivotably attached peripherally onto the casing 2 at circumferentially equal intervals. In this embodiment, four baffle vanes 5 are provided. The baffle vanes 5 are individually driven by actuators 11, such as motors to change their setting angles.

Figure 3:
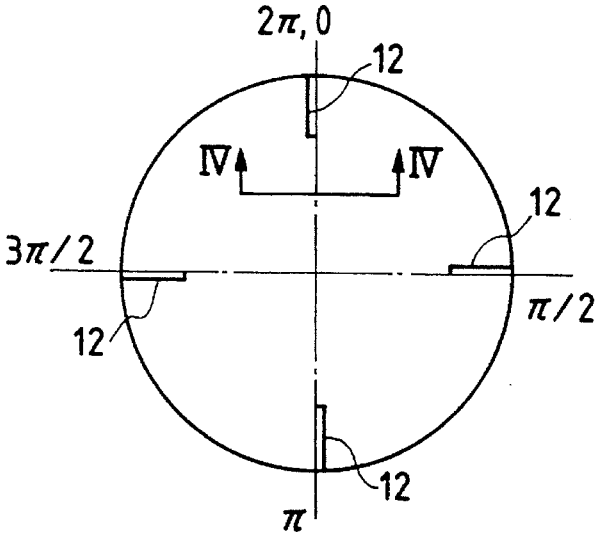
FIG. 3 is a front view showing an arrangement of a hot wire anemometer in the compressor shown in FIG. 1.
Figure 4:
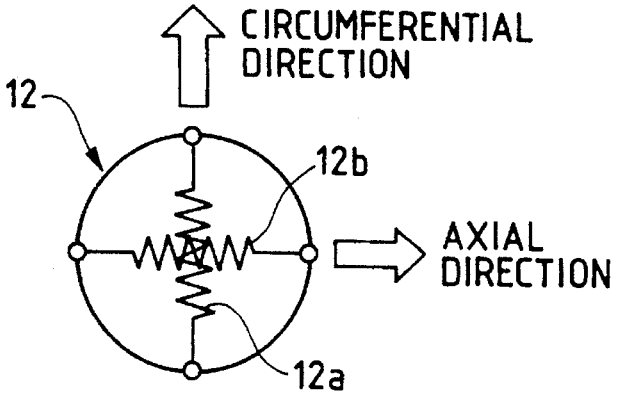
FIG. 4 is an enlarged view seen from the plane of the line IV—IV in FIG. 3.

Hot wire anemometers 12, operating as flow sensors for detecting the rotating stall or the circumferential distortion of flow are provided downstream of the baffle vanes 5 or upstream of the inlet guide vanes 6 with circumferentially equal intervals. The hot wire anemometer 12 has, as shown in FIG. 3 and FIG. 4, two hot wires perpendicular to each other, one is a first hot wire 12*a* which detects the magnitude of the flow velocity in the axial direction, and the other is a second hot wire 12*b* which detects the magnitude of the flow velocity in the peripheral or circumferential direction.

Figure 5:
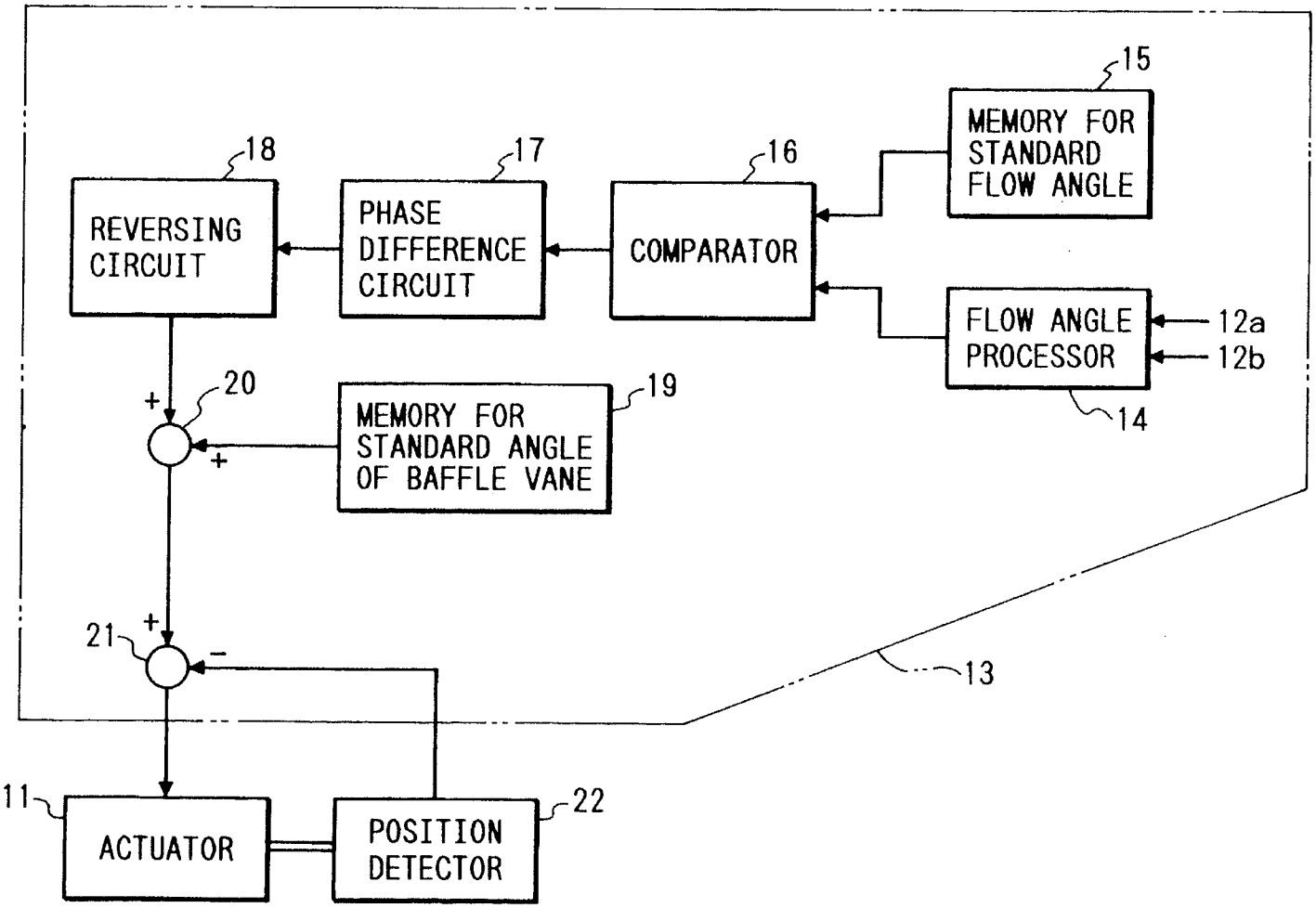
FIG. 5 is a block diagram showing a detailed structure of control means in the compressor shown in FIG. 1.

Referring to FIG. 5, control means 13 for varying the angles of the baffle vanes 5, illustrated in FIG. 1, comprises a flow angle processor 14 which receives signals from the first hot wire 12*a* and the second hot wire 12*b* in the hot wire anemometer 12 to obtain the flow angle of fluid velocity θ, a memory 15 which stores standard flow angle data, a comparator 16 which compares the standard flow angle values from the memory 15 with the detected flow angle values from the flow angle processor 14 to obtain the difference between them, a phase difference value obtained circuit 17 which produces a phase difference for the difference from the comparator 16 to compensate the positional delay and the fluid inertial delay due to the setting position interval between the baffle vanes 5 and the hot wire anemometers 12, a reversing circuit 18 which changes the sign of the difference value obtained from the phase difference circuit 17, a memory for standard 19 which stores the standard angle data for the baffle vanes 5, an adder 20 which adds the standard angle for baffle vanes from the memory 19 to the difference value obtained from the reversing circuit 18, and a subtracter 21.

The signals for controlling the baffle vanes vane angles as received from the adder 20 are supplied to the actuator 11 through the subtracter 21. The subtracter 21 receives the angle signals as a negative feedback from a position detector 22 installed in the actuator 11.

The memory 15 for standard flow angle data, as described above is set to store the standard flow angle value obtained in advance, however; it is also possible to store an average value of a plurality of the flow angles obtained from a plurality of the anemometers 12 as the standard angle value.

Next, the operation of the embodiment of a rotating stall prevention system according to the present invention as described above will be explained.

Figure 6:
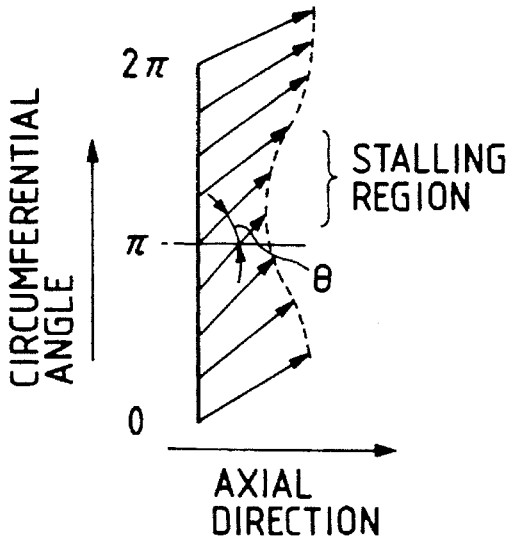
FIG. 6 is a peripherally unfolded graph showing velocity vectors under a condition of occurrence of a rotating stall to be prevented by a rotating stall prevention system in accordance with the present invention.

In a case, for example, where a stalling region takes place at a position of the peripheral angle of 180° as shown in FIG. 6, in the interval between the upstream side of the blade rows and the inlet of the blade rows the flow angle θ, angle between the flow velocity vector and the axial flow direction, increases at the region corresponding to the stalling region. By reducing the angle of the baffle vane corresponding to the peripheral position of the region where the angle θ is large, the direction of the fluid flow vector is forced to turn to decrease the stalling region in the blade rows. By controlling the angle of the baffle vanes while following the peripheral travelling direction of the stalling region, the rotating stall in the blade rows can be prevented.

Figure 7:
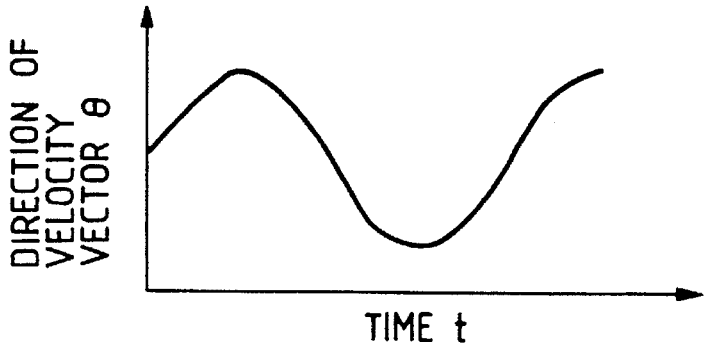
FIG. 7 is a characteristic graph showing velocity vector versus time under a condition of occurrence of a rotating stall to be prevented by a rotating stall prevention system in accordance with the present invention.
Figure 8:
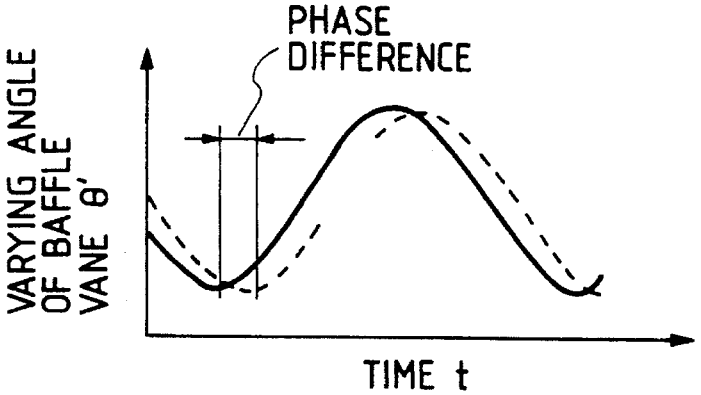
FIG. 8 is a characteristic graph showing baffle vane angles versus time on a rotating stall prevention system in accordance with the present invention.

Therein, the hot wire anemometer 12 for each corresponding peripheral angle where it is located detects the flow velocity in the axial direction and the flow velocity in peripheral direction. The flow angle processor 14 receives the detected signals from the hot wire anemometer 12 to obtain the flow angle of fluid velocity θ. The flow angle of fluid velocity θ changes, for example, sinusoidally with time as shown in FIG. 7. In the comparator 16, the flow angle of fluid velocity θ is compared with the standard flow angle values stored in the memory for standard flow angle 15 to obtain the difference between them. The difference is input to the phase difference circuit 17 to produce an advance phase difference to compensate the positional delay and the fluid inertial delay due to the setting position interval between the baffle vanes 5 and the hot wire anemometers 2, as shown in FIG. 8. In the reversing circuit 18, the difference value representing the phase difference has its sign changed. In the adder 20, the difference value of reversed sign is added to the standard angle of the baffle vanes 5 obtained from the memory for standard angle of baffle vane 19. Thus the adjustment valves for controlling the baffle vane adjustment valves are obtained. The angles for controlling the baffle vane angles are supplied to the actuator 11 through a subtracter 21. The actuator 11, as described above, operates to lessen the angle of the baffle vane corresponding to the peripheral position of the region where the angle 8 is large. As a result, the direction of the fluid flow vector is forced to turn to reduce the stalling region in the blade rows.

The control for the baffle vanes 5 is performed with a certain period so as to follow the peripheral travelling of the stalling region, since the stalling region travels in a manner. On the other hand, for the region not corresponding to the stalling region where the fluid flow angle θ is small, the control is preformed in the same manner as described above, such that the angle of the baffle vane 5 approaches the standard angle for the baffle vane to stabilize fluid flow.

The controlled angles of the baffle vanes. 5 are detected by the position detector 22 and are fed back to the subtracter 21 to maintain the controlled angles in agreement with the setting values.

According to the present invention, since the unsteady state flow field under a rotating stalling condition of the compressor is actively controlled by using the baffle vanes 5, the rotating stall can certainly be prevented. And, since there is no need for unsteady change of the angles of the inlet guide vanes 6 for preventing the rotating stall, the performance of the compressor is hardly affected.

Although hot wire anemometers 12 are used as flow sensors in the embodiment described above, pressure sensors or temperature sensors may be used instead of the hot wire anemometers. In this case, since the pressure and the temperature in the stalling region rise, the control may be performed such that the angles of the baffle vanes 5 in the peripheral position corresponding to the high pressure or high temperature region are lessened.

Further, although four flow sensors 12 and four baffle vanes 5 are provided in the embodiment described above, a more accurate control is possible if a larger number thereof is provided. However, at least three sensors are sufficient.

Figure 9:
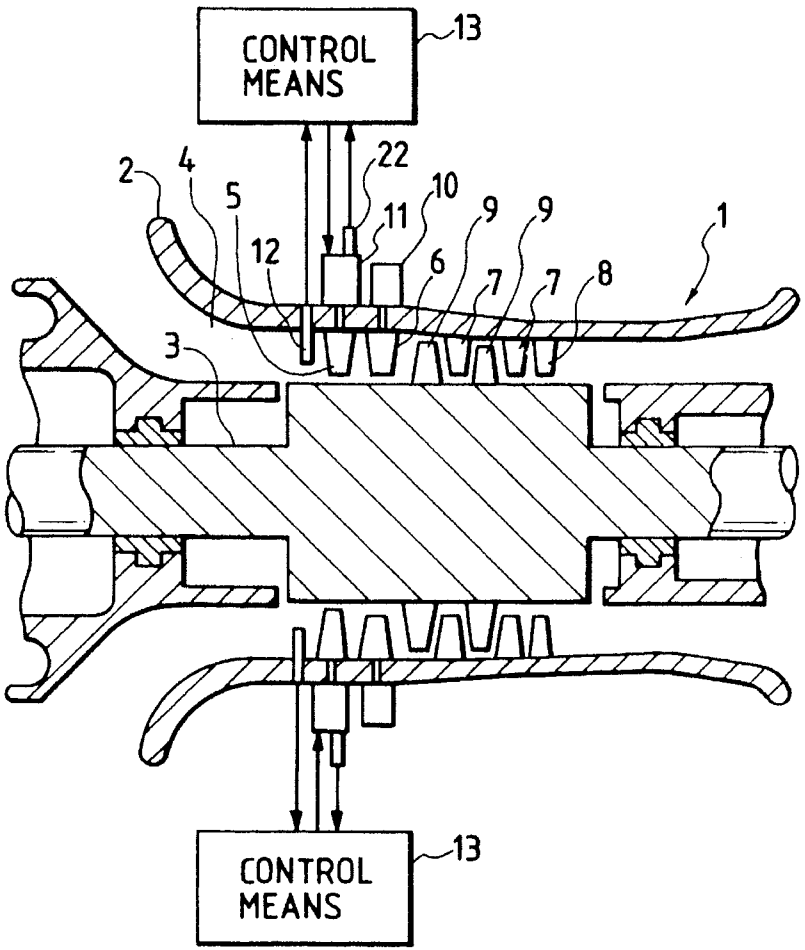
FIG. 9 is a longitudinal sectional view of a compressor incorporating another embodiment of a rotating stall prevention system in accordance with the present invention.

FIG. 9 shows a compressor representing another embodiment of a system according to the present invention. In this figure, the numerals refers to same parts in FIG. 1. In this embodiment, hot wire anemometers 12 are installed on the upstream side of the baffle vanes 5. Such a structure is also capable of obtaining the same effect as the embodiment described above.

Figure 10:
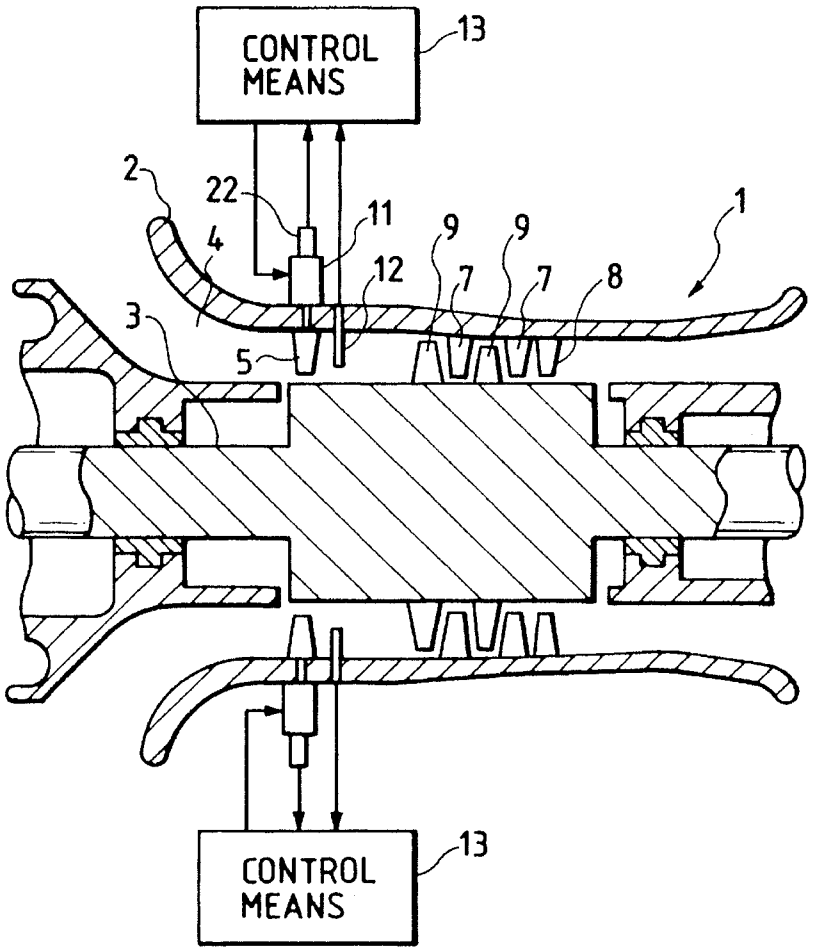
FIG. 10 is a longitudinal sectional view of a compressor incorporating a further embodiment of a rotating stall prevention system in accordance with the present invention.

FIG. 10 shows a compressor representing another embodiment of a system according to the present invention. In this figure, the numerals refers to same parts in FIG. 1. In this embodiment, the compressor is without inlet guide vanes 6, and a plurality of the baffle vanes 5 are provided on an upstream side of the rotor blades 9 on the inlet side, while sensors 12 are provided between the baffle vanes 5 and the rotor blades 9.

In this embodiment, the same effect as the embodiment described above is also obtainable.

Figure 11:
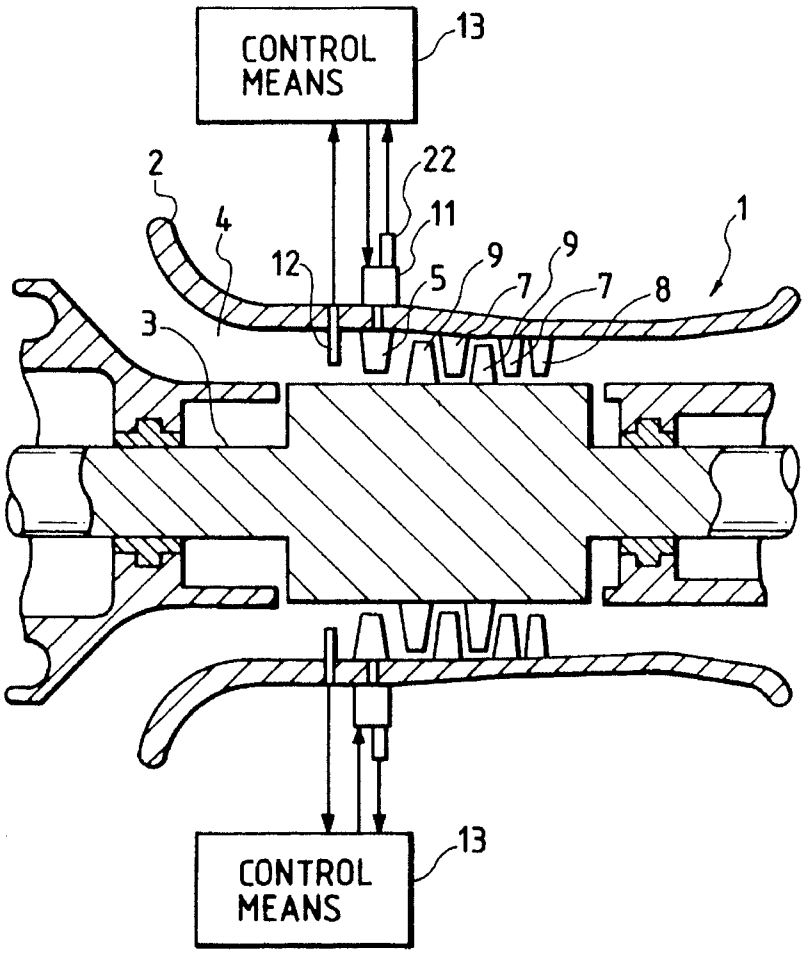
FIG. 11 is a longitudinal sectional view of a compressor incorporating a further embodiment of a rotating stall prevention system in accordance with the present invention.

FIG. 11 shows a compressor representing still another embodiment of a system according to the present invention. In this figure, the numerals refers to same parts in FIG. 1. In this embodiment, the compressor is without inlet guide vanes 6, and a plurality of the baffle vanes are provided on an upstream side of the rotor blades 9 and closely adjacent there to on the inlet side, while sensors 12 are provided upstream of the baffle vanes 5.

In this embodiment, the same effect as the embodiment described above is also obtainable.

Figure 12:
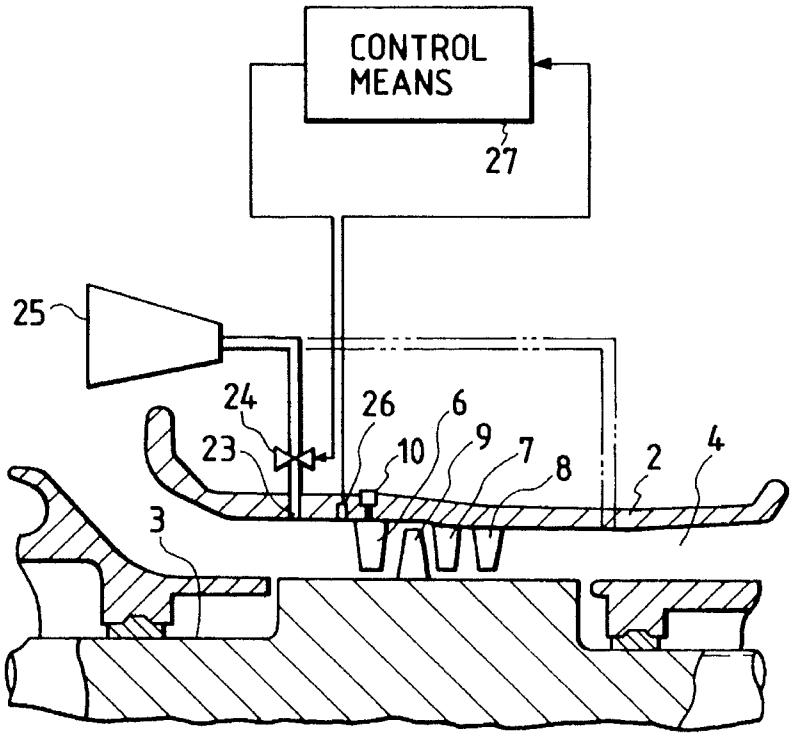
FIG. 12 is a longitudinal sectional view of a compressor incorporating a further embodiment of a rotating stall prevention system in accordance with the present invention.

FIG. 12 shows a compressor incorporating a further embodiment of a system according to the present invention. In this figure, the same numerals refer to same parts in FIG. 1. In this embodiment, a compressor comprises nozzles 23 to supply a jet flow on a casing 2 upstream of inlet guide vanes 6, a compressed fluid supply 25 connected to the nozzles 23 through valves 24, pressure signals from pressure sensors 26 provided in an upstream side of the inlet guide vanes 6 are input into control means 27, and the control means 27 regulates said valves 24. This control means 27 may be formed by changing the flow angle in the control means 13 in FIG. 1 to a pressure value.

According to this embodiment, when a rotating stall takes place, the pressure in the region corresponding to the stalling region between the upstream side of the blade rows and the inlet of the blade rows is high and the pressure in the non-stalling region is low. By increasing the jet flow from the nozzle 23 at the position corresponding to the low pressure region, the unevenness of pressure distribution in the peripheral direction can be eliminated to decrease the stalling region inside the blade rows. By performing this control while following the peripheral travelling of the stalling region, the rotating stall in the blade rows can be prevented.

According to the present invention, since the unsteady state flow field under a rotating stalling condition of the compressor is actively controlled, a high prevention effect against the rotating stall can be attained. And, by providing nozzles 23 for jet flow upstream of the inlet guide vanes 6, the performance of the compressor is hardly affected. Furthermore, there is an advantage that the structure is simpler than that for the embodiment using adjustment of the angles of the baffle vanes 5.

In the embodiment described above, an air compressor may be used as the pressurized fluid supply for the jet flow, or instead of using an air compressor, the fluid from the compressor itself may be utilized. And, temperature sensors may be used instead of the pressure sensors 26. Furthermore, a plurality of nozzles 23 to supply jet flow may be provided downstream of the inlet guide vanes 6.

According to the present invention, since the rotating stall can be prevented without deteriorating the performance of the compressor, the efficiency of the compressor increases and the reliability of components connected downstream thereof can be improved.

What is claimed is:

1. A rotating stall preventing system of a compressor, which has rows of compressing blades including rotor blades and stator blades in a flow passage of the compressor and means for performing flow control corresponding to the rotating speed of said compressor, said rotating stall prevention system comprising: baffle vanes separate from said means for performing flow control of said compressor, said baffle vanes being rotatably mounted in said flow passage upstream of said compressing blade rows so that their angles can be varied, actuators coupled to said baffle vanes to rotate said baffle vanes to vary their angles, flow sensors to detect flow condition in said flow passage of the compressor, and control means responsive to signals from said flow sensors for outputting control signals to said actuators for varying the angles of said baffle vanes so as to prevent occurrence of rotating stall phenomena.

2. A rotating stall prevention system of a compressor according to claim 1, wherein said flow sensors are located downstream of said baffle vanes.

3. A rotating stall prevention system of a compressor according to any one of claims 1 and 2, wherein said flow sensors produce signals representing flow velocity of fluid in the flow passage of the compressor.

4. A rotating stall prevention system of a compressor according to any one of claims 1 and 2, wherein said flow sensors produce signals representing an axial direction flow velocity and a circumferential direction flow velocity of fluid in the flow passage of the compressor.

5. A rotating stall prevention system of a compressor according to any one of claims 1 and 2, wherein at least three of said flow sensors are installed at circumferentially equal intervals in the flow passage of the compressor.

6. A rotating stall prevention system of a compressor according to claim 1, wherein said means for performing flow control comprises inlet guide vanes positioned between said compressing blade rows and said baffle vanes to perform flow control corresponding to the rotating speed of the compressor.

7. A rotating stall prevention system of a compressor according to claim 1, wherein said means for performing flow control comprises inlet guide vanes positioned between said compressing blade rows and said baffle vanes to perform flow control corresponding to the rotating speed of the compressor, and wherein said flow sensors are located downstream of said baffle vanes.

8. A rotating stall prevention system of a compressor according to any one of claims 6 and 7, wherein at least three of said inlet guide vanes and said flow sensors are installed at circumferentially equal intervals in the flow passage of the compressor.

9. A rotating stall prevention system of a compressor, which has rows of compressing blades including rotor blades and stator blades in a flow passage of the compressor and means for performing flow control corresponding to the rotating speed of said compressor, said means for performing flow control including inlet guide vanes positioned upstream of said compressing blade rows to perform flow control corresponding to the rotating speed of the compressor, said rotating stall prevention system comprising: flow sensors to detect the flow condition inside said flow passage of the compressor, and rotating stall prevention means, separate from and positioned upstream of said inlet guide vanes and responsive to detected signals from said flow sensors, for eliminating flow distortions in fluid flowing into said flow passage of the compressor, whereby rotating stall caused by said flow distortion is eliminated.

* * * * *